US005937991A

United States Patent [19]

Recondo Garayalde

[11] Patent Number: 5,937,991

[45] Date of Patent: Aug. 17, 1999

[54] LOCK ACTUATED BY AN INSERTION OBJECT SUCH AS A COIN OR TOKEN

[75] Inventor: Pedro Maria Recondo Garayalde, Madrid, Spain

[73] Assignee: Sistemas Y Tecnicas De Securidad, S.A., Madrid, Spain

[21] Appl. No.: 08/935,149

[22] Filed: Sep. 22, 1997

[30] Foreign Application Priority Data

Sep. 23, 1996 [ES] Spain ..... 9602009

[51] Int. Cl.[6] ..... G07F 17/12

[52] U.S. Cl. ..... 194/283; 194/334; 70/DIG. 41

[58] Field of Search ..... 194/247, 253, 194/259, 282, 283, 284, 288, 289, 334, 338, 905; 70/DIG. 41

[56] References Cited

U.S. PATENT DOCUMENTS 3,559,790 2/1971 Greenwald ..... 194/334 X 3,882,983 5/1975 Smith et al. ..... 194/283

FOREIGN PATENT DOCUMENTS 2836486 3/1980 Germany ..... 194/253

631022 7/1982 Switzerland ..... 70/DIG. 70

*Primary Examiner*—F. J. Bartuska

*Attorney, Agent, or Firm*—Lee, Mann, Smith, McWilliams, Sweeney & Ohlson

[57] ABSTRACT

A lock actuated by an insertion object. The actuated lock has a housing. The housing has an insertion slot for the insertion object. The lock has a passageway adjuster to exclude an undesirable insertion object. The lock has a first retainer which is vertically adjustable to a plurality of vertical positions. Each vertical position defines an insertion object passage. The insertion object passage has a length which is measured by the distance between the first retainer and the passageway adjuster. The insertion object travels in a pathway through the insertion slot, then through the passageway adjuster, and then through the insertion object passageway. The lock has a design which permits changing its handedness.

16 Claims, 6 Drawing Sheets

V
VI
IX

LOCK ACTUATED BY AN INSERTION OBJECT SUCH AS A COIN OR TOKEN

FIELD OF INVENTION

The present invention relates to a lock actuated by an insertion object such as a coin or token. More particularly, the invention relates to an actuatable lock having a passageway adjuster to exclude insertion objects such as coins or tokens which have undesirable dimensions.

BACKGROUND

Locks actuated by coins or tokens are known as coin-operated boxes. Coin-operated boxes (coin-actuated locks) are used to lock compartments such as luggage lockers. They are also used to secure objects to attachment devices. For instance, stores, transportation centers and ski areas use coin-actuated locks to secure objects in lockers. Additionally, ski areas utilize coin-actuated locks to lockably secure objects (skis) to an attachment device. Supermarkets use coin-actuated locks to secure shopping carts to an attachment device. Bicycle parking areas also use coin-actuated locks to secure bicycles to an attachment device.

Typically a user first places his or her objects in a storage position. In the case of a locker, the person places his or her belongings inside the locker. In the case of an attachment device, a person places the object for attachment in a storage position on the attachment device. The user then places the locker or attachment device in a closed position. In the case of a locker, a person would close the door. In the case of an attachment device such as a ski lock, the user closes a support bar. The person, after placing the locker or attachment device in the closed position, turns a key to a locked position and removes the key.

The user opens the locker or attachment device by inserting the key in a key cylinder of the coin-actuated lock. The person then rotates the key to the unlocked position. Rotation of the key causes the previously inserted coin or token to descend into a coin return area in the case of a free locker. The coin falls to a collection box in the case of a pay locker or a pay attachment device.

In the locker-type applications, the coin-actuated lock and collection box are mounted on the inside of the locker door. The coin-actuated lock and collection box thus face the interior of the locker when the locker door is closed. When the door is closed the coin-actuated lock and collection box are hidden.

In attachment device applications, the coin-actuated lock and collection box are mounted on an outside front face of the attachment device. The coin-actuated lock and collection device are thus always accessible to the user.

Installers of coin-actuated locks require coin-actuated locks to satisfy many requirements. For instance, installers from one country will need a coin-actuated lock (coin-operated box) to satisfy one coin format, and installers from another country will need a coin-actuated lock to satisfy another coin format. Also, installers need coin-operated boxes which will account for different locker-door handedness (i.e., right-handed v. left-handed).

To satisfy the different requirements, manufacturers produce a multitude of different coin-operated boxes. The boxes typically leave the factory designed for a specific coin format, a specific door handedness, and a specific lock fit, i.e., the distance between the key cylinder axis and the door edge from where the lock bolt emerges.

Producing different coin-operated boxes to satisfy individual requirements has caused problems. Manufacturers must produce and store a large number of different parts. Installers and operators of coin-operated boxes must replace the boxes to accommodate a change in operating conditions such as a change in door handedness or coin format.

Further, installers of the coin-actuated locks often have to replace coin-actuated locks to account for a change in locker design. For instance, a locker installation between two side walls has to have the lockers which abut the side walls opening in a different direction than the rest of the lockers. The abutting lockers require coin-actuated locks with different handedness. Thus, the addition of a wall may require an installer to have to replace coin-actuated locks.

The present invention seeks to overcome the above-noted problems by providing a coin-actuated lock which an installer can adjust to account for specific requirements of an operator such as coin format, lock fit, and door handedness. The present coin-actuated lock utilizes a passageway adjuster to accommodate different coin formats.

The passageway adjuster allows an installer to set up the coin-actuated lock so it will exclude all coins having a diameter greater than a desired diameter.

The invention further has a first retainer which is vertically adjustable relative to an abutment end of the passageway adjuster. The vertical adjustment ensures that the first retainer holds all coins having a diameter small enough to pass through the passageway adjuster when the first retainer is in a retention position. The vertical adjustment further ensures that the first retainer and passageway adjuster define an insertion object passageway to allow passage of the insertion object when the first retainer is in the release position. The ease of adjustment of the passageway adjuster and first retainer allows an installer or operator to adjust the coin-actuated lock to accommodate different coin formats.

The coin-actuated lock also has a feature which allows an installer to easily adjust the coin-actuated lock to satisfy different door handedness requirements. The coin-actuated lock has a housing. The housing includes a cover and a receptacle. Disposed within the housing is a lock bolt. The receptacle is designed symmetrically relative to a vertical plane. The cover for said receptacle is designed to be reversible to an opposite handedness by 180° coplanar rotation. The bolt is also symmetrical relative to a vertical longitudinal plane.

The coin-actuated lock is also easily adjustable by an installer to accommodate various lock fits. The cover has a key cylinder mounting site which allows for mounting of a key cylinder in a plurality of key cylinder positions corresponding to different distances from the door edge from which the lock bolt emerges. The lock bolt has a plurality of apertures to correspond to each of the key cylinder positions. An installer, by adjusting the key cylinder to the appropriate key cylinder position, can change the coin-actuated lock's fit.

Other desires, results and novel features of the present invention will become more apparent from the following summary, drawings, detailed description and accompanying claims.

SUMMARY

A lock actuated by an insertion object. The lock includes a housing with a receptacle and a cover. The cover has a plurality of sites for mounting a key cylinder; each of the sites defines a plurality of key cylinder positions. The cover is reversible by coplanar rotation of 180°. The receptacle is symmetrical along a vertical axis of the receptacle.

A bolt is adjustably coupled to the housing. The bolt is symmetrical relative to a vertical longitudinal plane passing through the bolt and is adjustable relative to the housing to an extended position and a retracted position. There is a means for adjusting the bolt to the extended position from the retracted position and from the retracted position to the extended position. A rotatable eccentric forms a part of the means for adjusting the eccentric and is coupled to the bolt.

There is a means for blocking the adjustment from the retracted position to the extended position. The means for blocking has a blocking position which blocks said adjustment of said bolt and an unblocking position which allows said adjustment of said bolt.

The lock actuated by an insertion object also has an insertion slot. The insertion slot receives the insertion object and is defined by the housing. A passageway adjuster defines a variable length passage. The passageway adjuster is adjustable to vary the variable length passage to receive the insertion object. The passageway adjuster forms means for preventing an undesirable insertion object, having dimensions different from said insertion object, from passing through the variable length passage.

A first retainer is adjustable to an insertion object release position by positioning of the bolt to the extended position. The first retainer is adjustable to an insertion object retention position by positioning of the bolt to the retracted position.

The first retainer is vertically adjustable to a plurality of vertical positions, each vertical position defining an insertion object passage. The length of said insertion object passage is a distance between the first retainer and the passageway adjuster when the first retainer is in its first insertion object release position. The insertion object passage permits passage of the insertion object.

The lock includes means to change its orientation from right-handed to left-handed.

The lock has a pathway whose beginning is marked by the insertion slot.

A first sliding wall forms a part of the passageway adjuster and is slidably and adjustably disposed in a first slot. A second sliding wall forms a part of the passageway adjuster and is slidably and adjustably disposed in a second slot.

A first transverse ratchet defines a portion of the first and second slots.

A second transverse ratchet is disposed on the first sliding wall and the second sliding wall.

The first transverse ratchet and the second transverse ratchet interlock to permit slidable adjustment of the first and second sliding walls to vary the variable length passage.

A first vertical ratchet is disposed on the first retainer. A second vertical ratchet interlocks with the first vertical ratchet. The interlocking of the first vertical ratchet and the second vertical ratchet permits adjustment of the first retainer to said plurality of vertical positions.

DETAILED DESCRIPTION

Figure 1:
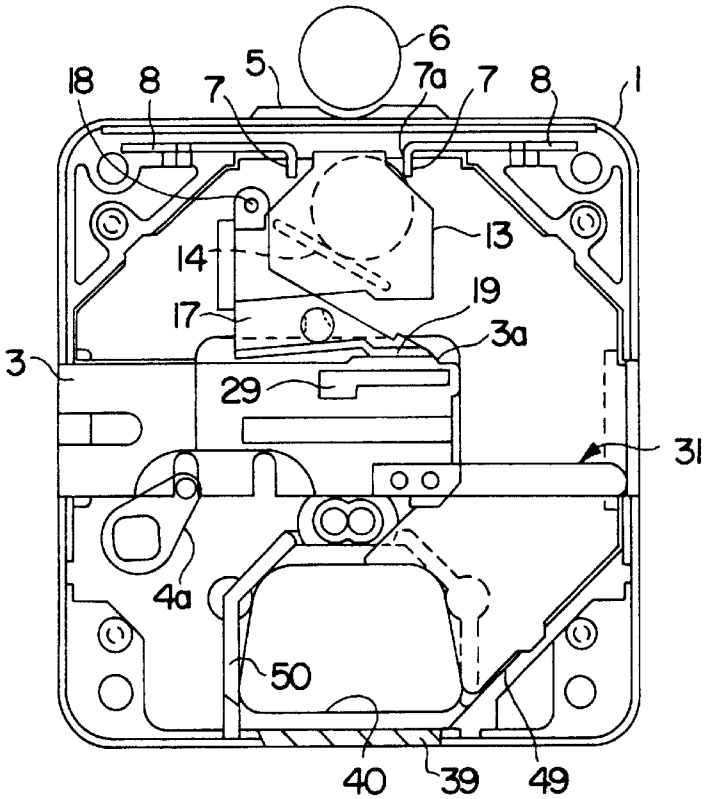
FIG. 1 depicts the coin-operated box according to the invention, viewed from the side of the key cylinder (not shown), as if the cover (2) were transparent or had been removed. Included is the passageway adapter (7), along with the first retainer (13), the oscillating support (17) the bolt (3) and the second retainer (31).
Figure 11:
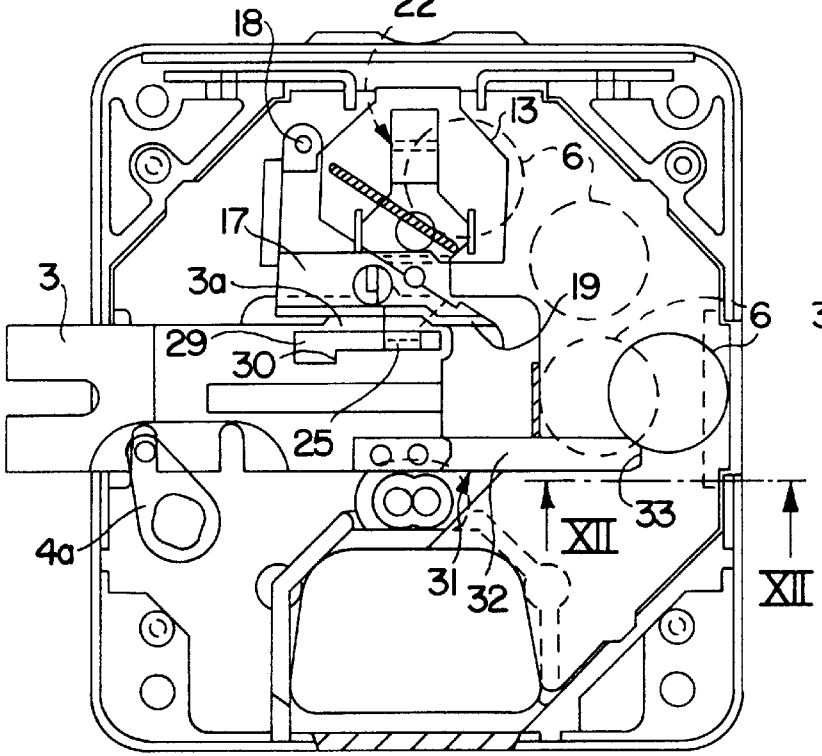
FIG. 11 is like FIG. 1, except the bolt (3) is extended.
Figure 17:
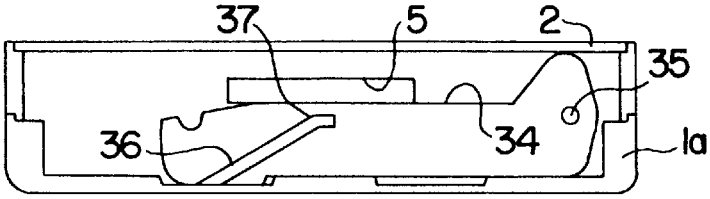
FIGS. 16 and 17 are the respective cross-sections XVI—XVI and XVII—XVII marked in FIG. 15.
Figure 16:
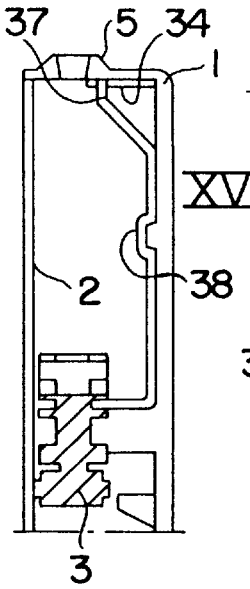
Figure 15:
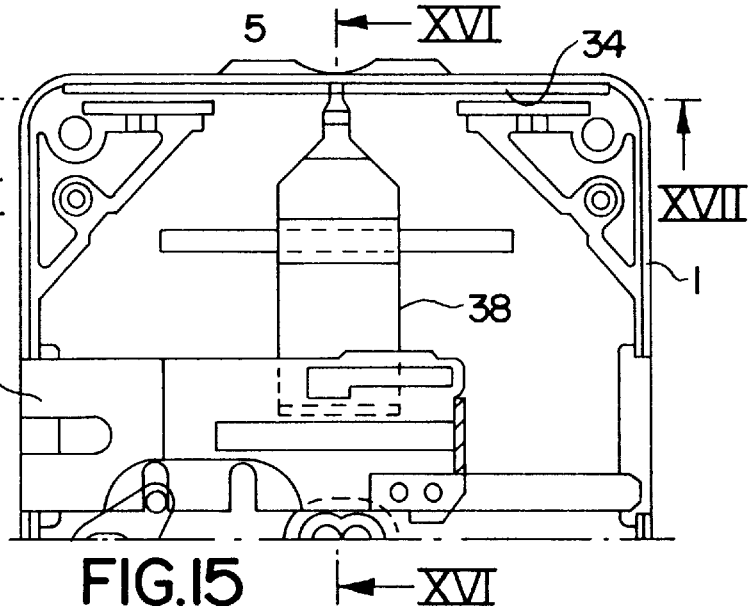
FIG. 15 depicts the top part of the coin-operated box according to FIG. 1, but includes a vertically elongated member (38) and a rotatable shutter (34); the shutter is in a first shutter position.
Figure 19:
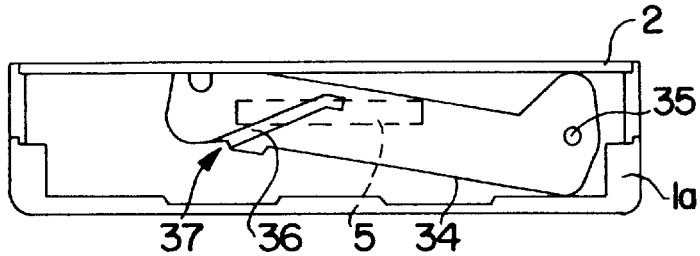
FIGS. 18 and 19 are equivalent to FIGS. 15 and 17, except the shutter is in a second shutter position.
Figure 18:
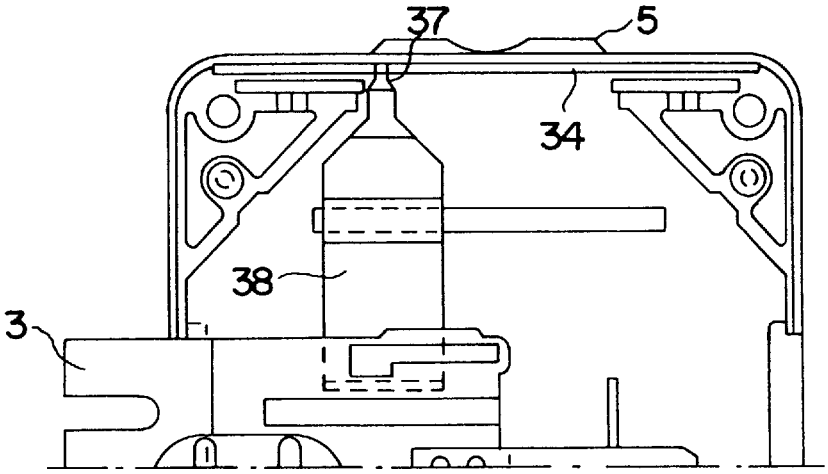
Figure 21:
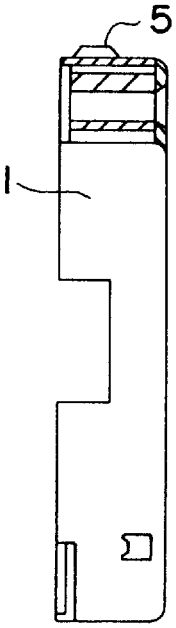
FIG. 21 is the right lateral view of FIG. 20, with a partial section showing one of the wall anchoring holes.
Figure 20:
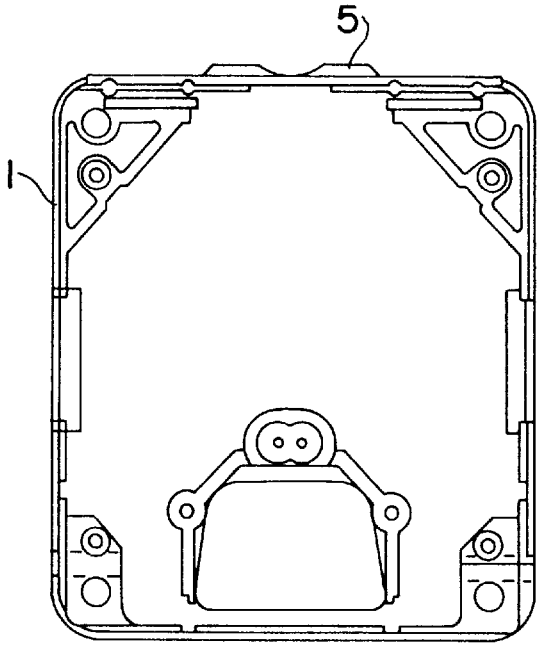
FIG. 20 depicts in isolation the housing (1) as in FIG. 1.
Figure 23:
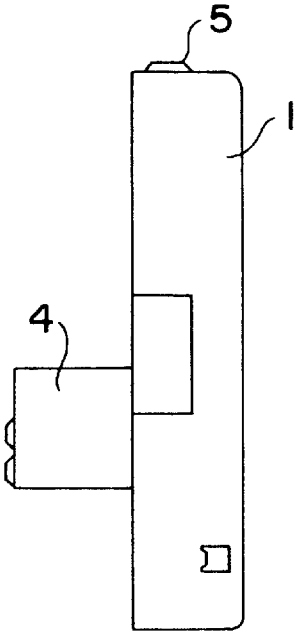
FIG. 23 is the right lateral view of FIG. 22.
Figure 22:
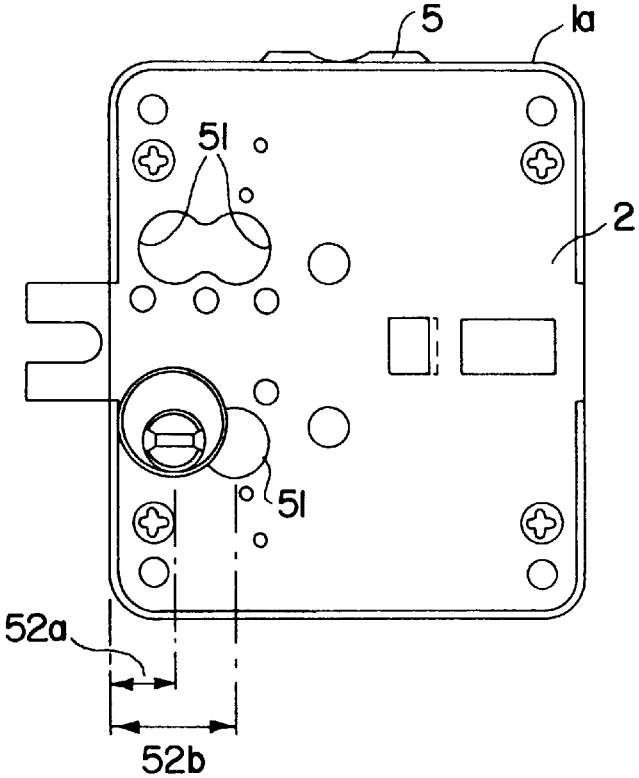
FIG. 22 depicts the coin-operated box of the present invention; the figure includes the cover (2) and key cylinder (4) and shows the bolt (3) extended.

The present invention concerns an actuated lock. The lock is actuated by an insertion object such as a coin or a token. FIG. 1 depicts a coin-actuated lock known as a coin-operated box. The coin-actuated lock has a housing (1) with an insertion slot (5). Beneath the insertion slot is a passageway adjuster (7). A user inserts a coin (6) through the insertion slot (5). The coin passes through the insertion slot and the passageway adjuster and into a first retainer (13). The disposition of the coin in the first retainer causes mechanical events which unblock a bolt (3). The unblocking of the bolt allows the user to move the bolt to a locked (extended) position. A user rotates a key disposed in a key cylinder to place the bolt in the extended position. (FIG. 1 shows the bolt in the retracted position; FIG. 11 shows the bolt in the extended position.)

During movement of the bolt to the extended position (FIG. 11), the coin (6) disembarks from the first retainer and falls vertically downward to a second retainer (31). The coin is retained by the second retainer (FIG. 12) and the bolt is in the extended position. A user then removes the key, which is only removable from the key cylinder when the key is rotated to place the bolt in the locked (extended) position.

Figure 14:
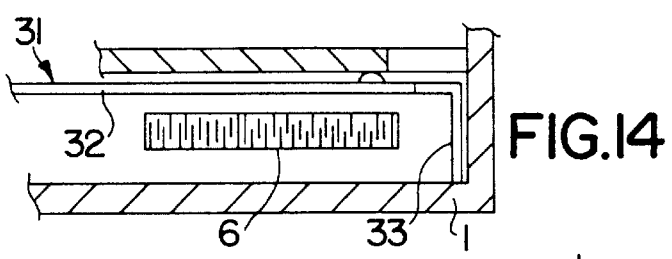
FIG. 14 is like FIG. 12, but relative to FIG. 13.
Figure 13:
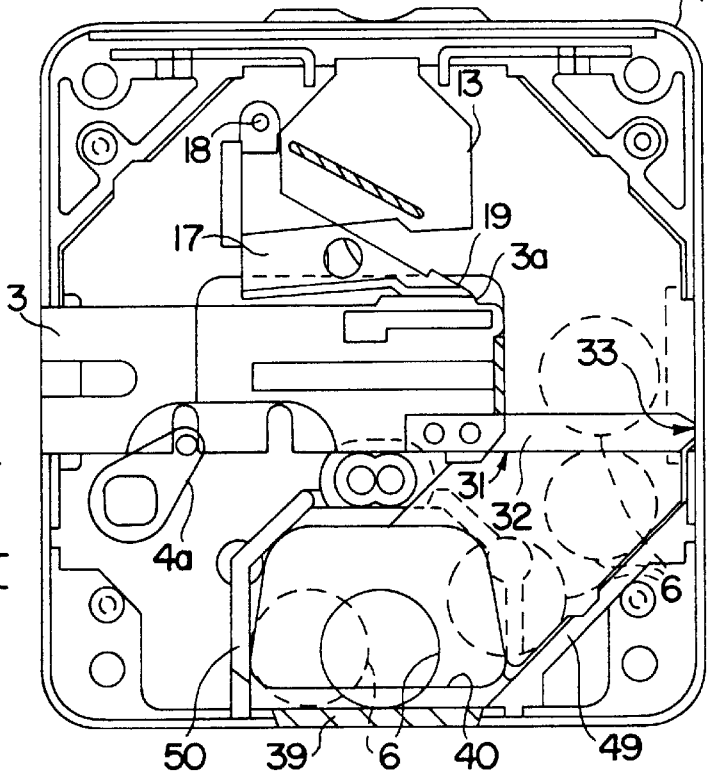
FIG. 13 is like FIG. 11, except the rocker (22) is omitted, the bolt is retracted, and the coin (6) has reached the coin return box (40).

A user to unlock the coin-actuated lock rotates the key to an unlocked position. Rotating the key to the unlocked position moves the bolt to a position of retraction (FIG. 13). Movement of the bolt to the retraction position causes the coin to disembark the second retainer (FIG. 14). The coin then falls to a coin box (41) or a coin return box (40).

The passageway adjuster (7) is located immediately beneath the insertion slot (5). The passageway adjuster (7) defines a transverse passage for the coin inserted into the coin-operated box. The passageway adjuster (7) has an abutment end surface (7*a*) which defines an end of the transverse passage. The passageway adjuster is capable of being adjusted by an installer to exclude all coins having a diameter greater than the transverse length of the coin passage defined by the passageway adjuster (7). The passageway adjuster can be repeatedly adjusted by an installer within a broad range of values defined by the fixed dimensions of the insertion slot (5).

Figure 2:
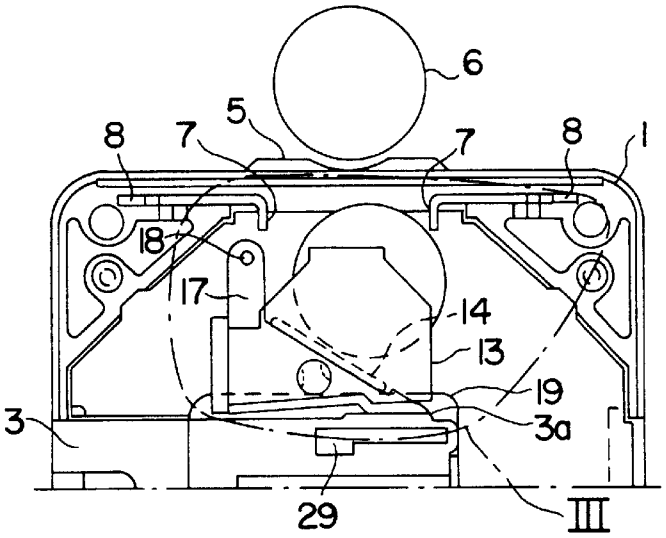
FIG. 2 depicts the upper half of the coin-operated box of FIG. 1, adapted to a larger coin setting than the setting in FIG. 1.
Figure 3:
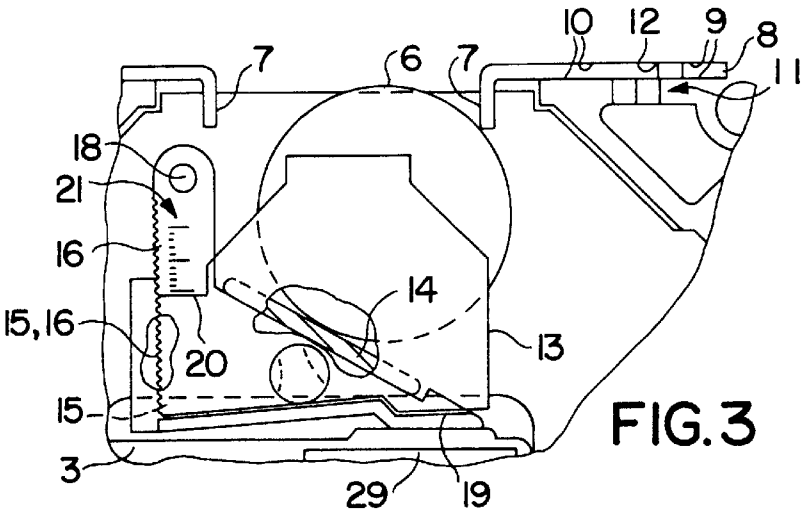
FIG. 3 is an enlarged depiction of detail III indicated in FIG. 2.

The first retainer (13) is below the passageway adjuster. The first retainer has a ramp (14) at its base. A portion of the ramp (14) slopes vertically away from the abutment end surface (7*a*) of the passageway adjuster. An installer adjusts the first retainer (13) to ensure that when a coin (6) passes into the coin-operated box the first retainer will retain the inserted coin when the first retainer is in a retention position. The coin is supported in the first retainer by the retainer ramp and by the passageway adjuster abutment end surface (7*a*). The installer adjusts the first retainer by adjusting the vertical position of the first retainer. The installer vertically positions the first retainer so that a vertical distance separating the first retainer ramp and the passageway adjuster abutment end surface, when the first retainer is in the retention position, is slightly less than the diameter of the largest coin able to pass through the passageway adjuster (FIG. 2).

An oscillating support (17) bounds and supports a side of the first retainer (13). The oscillating support is coupled to the first retainer. The oscillating support and the first retainer oscillate together as a single unit. The oscillating support (17) and the first retainer (13) oscillate between the position of retention (upper position) and a position of release (lower position). When the oscillator support and first retainer are in the position of retention, the first retainer retains the coin. When the oscillator support and first retainer are in the release position, the coin is released from the first retainer (13).

The oscillation of the oscillator support between the retention and release positions is coincident with the retracted and extended state of the bolt (3). When the bolt is in the retracted position, the oscillating support is in the retention position; and when the bolt is in the extended position, the oscillating support is in the release position.

The oscillating support (17) has a shape which defines a right angle. The vertical arm of the oscillating support is suspended from an axis of oscillation (18). A horizontal arm of the oscillating support forms a right angle with the vertical arm. An end of the horizontal arm forms a heel which extends vertically downward towards the bolt (3). The oscillating support heel extends vertically downward about the same distance that a bolt protrusion (3*a*) extends vertically upward. The bolt protrusion (3*a*) on the bolt pushes the oscillating support heel in a vertically upward position towards the insertion slot (5) when the bolt is in the retracted position (FIG. 1). The first retainer and oscillating support are set in the retention position when the heel is in the upward position.

The oscillating support horizontal arm has a recessed portion adjacent to the oscillating support heel (19). The recessed portion adjacent to the heel is recessed away from the bolt protrusion (3*a*). The recessed portion has a length which accommodates the bolt protrusion when the bolt is in the extended position.

When the bolt (3) is in the extended position: the bolt protrusion is accommodated in the oscillating support recess, the oscillating support heel is in a lowered position, the oscillator support and the first retainer are in the release position, the vertical distance separating the retainer ramp (14) and the passageway adjuster abutment end surface (7*a*) is greater than the diameter of the inserted coin, and the inserted coin disembarks by gravity from the first retainer.

In order for a user of the coin-actuated lock to move the bolt from the retracted position to the extended position, a rocker (22) must be placed in a position of unblocking to release the bolt. Insertion of a coin in the first retainer causes the rocker to oscillate from a blocking position to the unblocking position. In the unblocking position the bolt is in a release position and is free to move to the extended (locked) position (FIGS. 4–10). Prior to disposition of the coin in the first retainer, the rocker is in a blocking position. In the blocking position, the rocker prevents the bolt from moving from the retracted position to the extended position.

Figures 4, 5, 6, 7, 8, 9, 10:
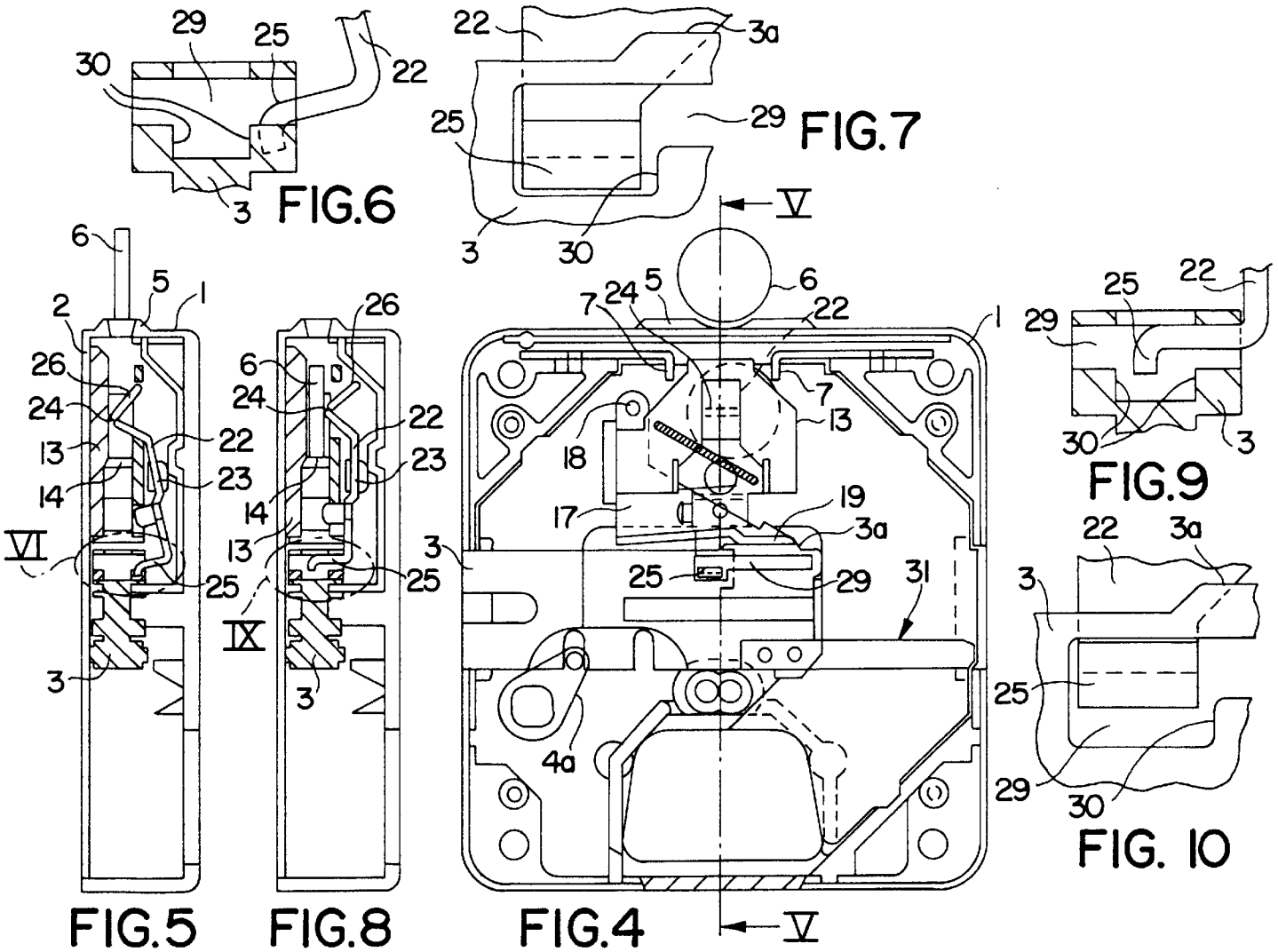
FIG. 4 is similar to FIG. 1, but includes a rocker (22) in its blocking position.
FIG. 5 is the cross-section V—V marked in FIG. 4.
FIG. 6 is an enlarged depiction of detail VI circled in FIG. 5.
FIG. 7 is the left lateral view of FIG. 6.
FIG. 8 is like FIG. 5, except it depicts the rocker (22) in the unblocking position.
FIG. 9 is an enlarged depiction of detail IX circled in FIG. 8.
FIG. 10 is a left lateral view of FIG. 9.

The rocker (22) extends vertically downward from the first retainer to the bolt. The rocker (22) has a first rocker protrusion and a second rocker protrusion (25). The first and second rocker protrusions are vertically opposite each other. An angular bend (24) forms the first rocker protrusion. The angular bend has a vertex and an inclined plane (26). The angular bend extends into an open coin retention area defined by the first retainer. The angular bend vertex abuts up against an inner surface of the first retainer when the rocker is in the blocking position (FIG. 5). The angular bend is disposed between the insertion slot (5) and the first retainer ramp (14).

The second rocker protrusion is disposed in an aperture (29) defined by the bolt. A step (30) defines a lower portion of the aperture (29). The second rocker protrusion extends into the lower aperture and provides an abutment to the bolt step (30) when the rocker (22) is in the blocking position.

Inserting the coin in the first retainer oscillates the rocker (22) from the blocking position to the unblocked position. The inserted coin has a face surface which presses against the angular bend and moves the angular bend transversely away from the open coin retention area defined by the first retainer. The movement of the angular bend causes a simultaneous movement of the second rocker protrusion. The second rocker protrusion is moved so that it is above the step (30) defining the lower portion of the aperture. The rocker is in the unblocked position.

The rocker can be maintained in the blocking position by gravity. Additionally, the blocking position of the rocker (22) can be exemplified by a spring.

Upon unblocking of the bolt, a user can place the bolt in the extended (locked) position. The user turns a key which rotates an eccentric (4*a*) of the key cylinder (4). The eccentric imparts a transverse movement to the bolt causing the bolt to move to the extended position.

The extension of the bolt causes the coin to disembark the first retainer and fall vertically downward. The coin falling vertically downward is stopped by a second retainer (31). The second retainer (31) has a second retainer first member (32) and a second retainer second member (33). The first member extends in the same direction as the bolt. The second member extends transversely to the first member. An end of the first member is attached to the bolt.

Figure 12:
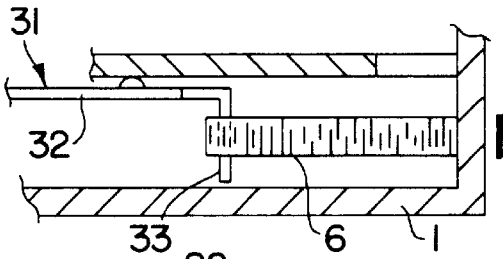
FIG. 12 is an enlarged depiction of the cross-section XII—XII marked in FIG. 11.

The second retainer (31) moves simultaneously with the bolt's movement to the extended and retracted states. The bolt when moved to the extended state places the second retainer in an interference position. In the interference position the second retainer second member is in the pathway of the descending coin. The second member in the interference position blocks and retains the inserted coin after it has disembarked from the first retainer (FIG. 12).

The bolt when moved to the retracted state from the extended state places the second retainer (31) in a clearance position. In the clearance position the second member is out of the way of the inserted coin. The clearance position allows the coin to descend into either a coin box (41) or a coin return box (40). Prior to entering the coin return box or coin box, the coin passes over an inclined plane formed by a removable corner bracket (49). The bracket ensures that the coin ends up in the coin box (41) or the return box (40). A stop (50) is located at an opposite end of the return box or coin box to also ensure the coin ends up in the proper location.

A removable tray (39) functions as the floor of the return box (40). The removable tray is coupled to a bottom portion of the housing. The removable tray coupled to the housing blocks the descent of the coin to the collection box (41). The removable tray thus constitutes the floor of the return area (40) to return coins to the user.

Figure 27:
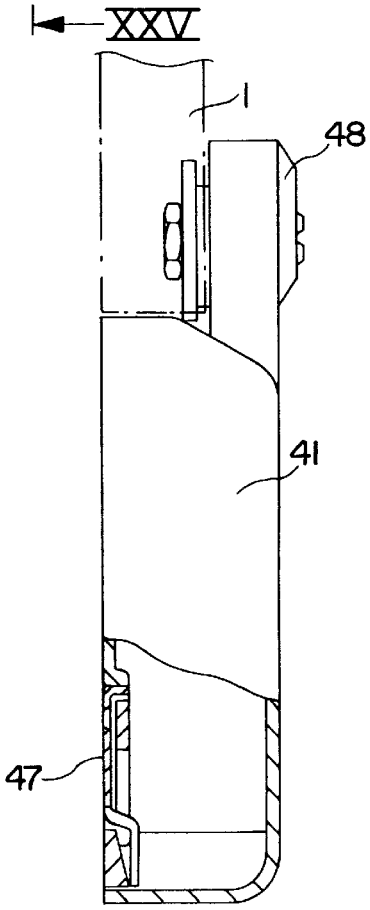
FIG. 27 is the left lateral view of FIG. 26 and depicts a partial section which makes it possible to see a wall anchor (47) onto which the collection box (41) is fastened.

The collection box is connected to a mounting surface by means of a wall anchor (47) (FIG. 27). The anchor is connected by an oblique downward movement of the collection box towards the wall. The collection box is connected to the housing by way of a lock (48). The connection of the box to the housing by way of the lock (48) uses the space previously reserved for the return box (40).

Prior to a user's insertion of coin (6), an installer should adjust the passageway adjuster (7) to exclude all coins having a diameter greater than the length of the transverse passage (variable length passage) defined by the passageway adjuster (7). The passageway adjuster incorporates structures to allow adjustment. The passageway adjuster includes a pair of sliding walls (7). The sliding walls (7) are each slidably disposed in a different housing slot (8).

Each housing slot (8) has a pair of first transverse ratchets (9). One ratchet from each pair of first transverse ratchets (9) is disposed on a surface defining the housing slots. The other ratchet from each pair of first transverse ratchets is disposed on an opposite surface defining the slots.

Each sliding wall (7) has a pair of second transverse ratchets (10). One ratchet from each pair of second transverse ratchets is disposed on the sliding walls to face a first ratchet. The other ratchet from each pair of second transverse ratchets is disposed on the sliding walls to face another first transverse ratchet.

The first transverse ratchets (9) interlock with the second transverse ratchets (10). The ratchets interlock to allow gradual fixed adjustment of the sliding walls relative to the housing slots (8). The ratchets are configured in 0.5 mm increments to allow adjustment of the passageway adjuster (7) so that coins greater than a specific diameter cannot pass through the variable length passage and into the first retainer.

Adjusting the passageway adjuster to exclude certain coins requires the installer to also adjust the vertical position of the first retainer. The first retainer has a retainer vertical surface. The retainer vertical surface extends vertically relative to the length of the coin passage. The first retainer vertical surface has a first vertical ratchet (15). The first vertical ratchet (15) interlocks with a second vertical ratchet (16) along the oscillating support vertical arm. The ratchets interlock to allow gradual fixed adjustment of the first retainer in a vertically upward or vertically downward direction. The first retainer's vertical position adjusts relative to the oscillator and the housing. The oscillator's vertical position remains fixed relative to the housing during vertical adjustment of the retainer. The first retainer is vertically adjusted along the vertical length of the oscillator support vertical arm.

The retainer is adjusted vertically by an installer to coincide with the operator's adjustment of the passageway adjuster (7). A passageway adjuster adjusted to define a larger coin passage from a smaller coin passage requires an installer to adjust the first retainer vertically downward. The downward vertical adjustment increases the vertical distance separating the first retainer ramp and the sliding wall abutment end surface **(7*a*)**. Increasing the vertical distance ensures that when the first retainer moves to the release position, the vertical distance separating the retainer ramp and the abutment end surface is greater than the diameter of the inserted coin. The vertical distance must be greater to ensure that the coin disembarks the first retainer when the first retainer moves to the release position.

The coin-operated box has units of measurement (scales) to simplify adjustment of the passageway adjuster and the first retainer. A scale (21) is disposed along the oscillating support vertical arm. A scale (11) is disposed along a part of the coin-operated box forming the slots (8). The scales are formed by etching or bias-relief. The scale associated with the first retainer (21) is referenced to zero by a marking (20) on the first retainer. The scale (11) is referenced to zero by a marking (12) on the sliding wall (7).

In addition to adjusting the coin-actuated lock to exclude certain coins, the coin-actuated lock can be adjusted by an installer to account for different handedness. The housing includes a receptacle **(1*a*) and a cover (2). The receptacle is designed symmetrically relative to a vertical plane. The cover is designed to be reversible by coplanar rotation of 180°. The bolt is symmetrical relative to its vertical longitudinal plane. Thus an installer by making some simple alterations to the positioning of certain components, including the cover (2), the bolt (3) and associated second retainer (31), the first retainer (13) and associated oscillating support (17), the key cylinder ((4) and associated eccentric (4*a*), the corner bracket (49) and stop (50)**, can change the handedness of the coin-actuated lock.

The coin-actuated lock also allows for easy adjustment of the key cylinder relative to the emerging edge of the bolt (3). The cover has sites (51) for mounting the key cylinder (4). Each site (51) defines a plurality of key cylinder positions. A first position (52) places the key cylinder so that its axis is closer to the emerging edge of the bolt than when the key cylinder is in a second key cylinder position **(52*b*). The bolt has two apertures which correspond to the first and second key cylinder positions. The key cylinder eccentric (4*a*) couples to the first aperture when the key cylinder is in the first key cylinder position. The eccentric (4*a*)** couples to a second aperture when the key cylinder is in the second key cylinder position. Thus an installer can adjust the key cylinder to have a particular fit, i.e., the cylinder has a particular distance from the edge of the housing where the bolt emerges.

The coin-actuated lock has a feature which prevents a second coin from being inserted into a coin-actuated lock designed for coupling to an attachment device. The coin-actuated lock has a rotatable shutter (34) disposed in a plane between the insertion slot (5) and the passageway adjuster (7). The shutter has an oblique aperture (36). A vertically elongated member (38) couples the shutter to the bolt. A first end of the vertically elongated member (37) is disposed in the oblique aperture (36). A second end of the aperture is removably coupled to the bolt.

The rotatable shutter (34) is capable of occupying two positions. In the first shutter position, the shutter interferes with a coin pathway between the insertion slot and the passageway adjuster, thereby preventing insertion of a coin. Movement of the bolt (3) to an extended position imparts a transverse movement to the vertically elongated member. The first end of the vertically elongated member presses against a surface defining the oblique aperture (36) and forces the shutter to rotate around its axis (35). The shutter is rotated to the first shutter position. In the first shutter position the shutter is disposed between the insertion slot (5) and the passageway adjuster (7).

In the second shutter position the shutter is removed from the coin pathway and a coin can be inserted into the coin-actuated lock. Movement of the bolt from an extended to a retracted position imparts a movement to the vertically elongated member (38). The first end of the vertically elongated member presses against the surface of the aperture (36). The shutter is then rotated to the second shutter position, in which the shutter is removed from the coin pathway.

Additionally, the coin-actuated lock provides for the possibility that the rocker (22) is activated by an electromagnet. The electromagnet would be activated by a signal emitted by an electronic recognition circuit of a magnetic card or by an encoded remote radio, infrared, ultrasound or similar signal. The electromagnet is activated and causes said rocker to move to said unblocking position. The electromagnet would have its axis associated with the rocker (22).

Figure 24:
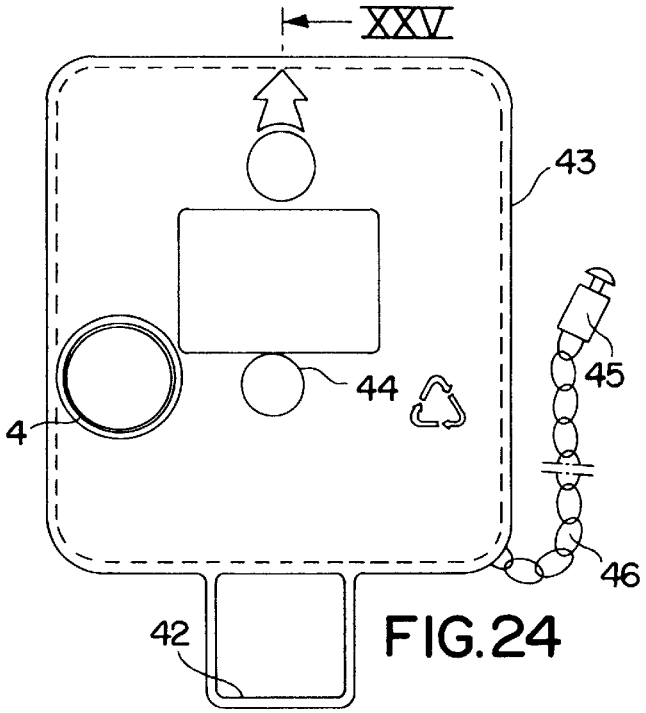
FIG. 24 is the front view of a coin-operated box of the present invention provided with a removable cover (43) having application for use with an attachment device for securing objects; the figure includes a chain (46) and a peg (45).
Figure 26:
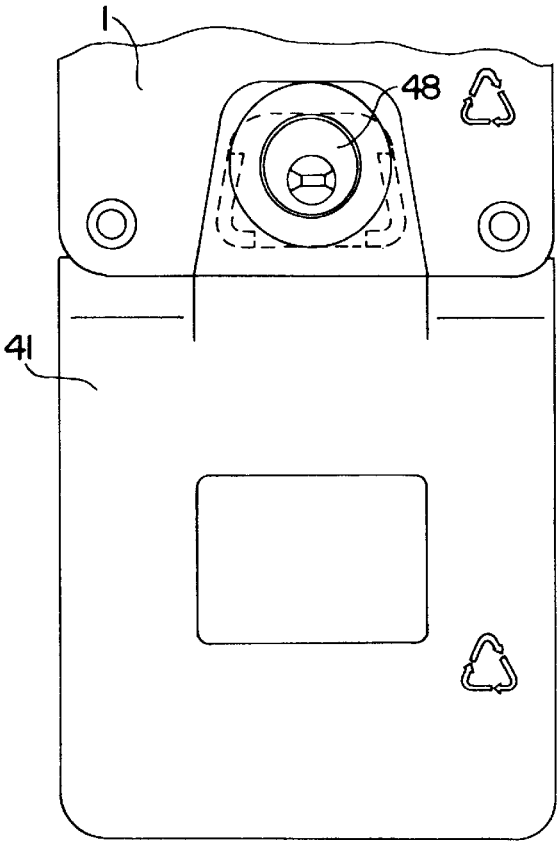
FIG. 26 depicts a collection box (41) coupled with a coin-operated box according to the invention, of which only a lower portion appears.

The coin-operated box designed for use with an attachment device for securing objects has an object-securing member connected to the housing (FIG. 24). The object-securing member shown consists of a chain connected to the housing and a peg at a free end of the chain. To secure the object, the chain is wrapped around the object. The peg (45) is inserted through a hole (45) in the housing. The key cylinder is rotated to a locking direction and imparts a transverse movement in bolt (3). The bolt (3) moves to a locking (extended) position. In the locking position, a projection on the bolt couples with a notch in the peg to lock the peg in place.

Figure 25:
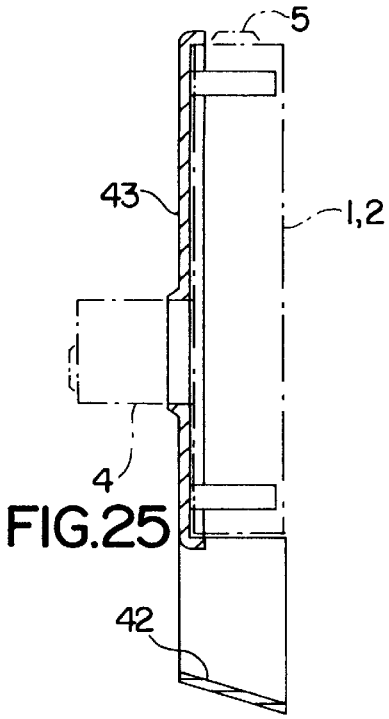
FIG. 25 is the cross-section XXV—XXV marked in FIG. 24 and where the housing is outlined using a broken line.

An actuated lock designed for use with an attachment device utilizes a removable cover (43) (FIGS. 24 and 25). The removable cover has a return receptacle (42). The return receptacle (42) allows for return of the coin to the user.

Further provision is made for an auxiliary coin tube (not shown). The auxiliary coin tube couples the insertion slot (5) to a hole in a locker door. The tube provides a passage to direct the coin from a hole in the locker door to the insertion slot (5). The auxiliary tube is used when the coin-actuated lock is mounted on the interior of a locker door.

It is important to note that the present invention has been described with reference to an example of an embodiment of the invention. It would be apparent to those skilled in the art that a person understanding this invention may conceive of changes or other embodiments or variations which utilize the principles of the invention without departing from the broader spirit and scope of the invention as set forth in the appended claims. The specifications and drawings are therefore to be regarded in an illustrative rather than a restrictive sense. Accordingly, it is not intended that the invention be limited except as may be necessary in view of the appended claims.

I claim:

1. A lock actuated by an insertion object comprising:

a housing, said housing including a receptacle and a cover;

said cover having a plurality of sites for mounting a key cylinder, each of said plurality of sites defining a plurality of key cylinder positions, said cover reversible by coplanar rotation of 180°;

said receptacle being symmetrical along a vertical axis of said receptacle;

a bolt adjustably coupled to said housing, said bolt being symmetrical relative to a vertical longitudinal plane passing through said bolt, said bolt being adjustable relative to said housing to an extended position and a retracted position;

means for adjusting said bolt to said extended position from said retracted position and from said retracted position to said extended position;

a rotatable eccentric forming a part of said means for adjusting, said eccentric coupled to said bolt;

means for blocking said adjustment from said retracted position to said extended position, said means for blocking having a blocking position which blocks said adjustment of said bolt by said means for adjusting, said means for blocking having an unblocking position to allow for adjustment of said bolt by said means for adjusting;

an insertion slot to receive the insertion object, said insertion slot defined by said housing;

a passageway adjuster defining a variable length passage, said variable length passage to receive said insertion object, said passageway adjuster forming means for preventing an undesirable insertion object, having dimensions different from said insertion object, from passing through said variable length passage;

a first retainer adjustable to an insertion object retention position and an insertion object release position, said first retainer adjustable to said insertion object release position by positioning of said bolt to said extended position, said first retainer adjustable to said first object retention position by positioning of said bolt to said retracted position;

said first retainer vertically adjustable to a plurality of vertical positions, each of said plurality of vertical positions defines an insertion object passage, said insertion object passage being a distance between said first retainer and said passageway adjuster, said insertion object passage permitting passage of said insertion object;

means for changing said lock actuated by an insertion object from a right-handed orientation to a left-handed orientation;

a pathway for said insertion object defined by said lock actuated by an insertion object, wherein said insertion slot marks a beginning of said pathway.

2. The lock actuated by the insertion object as set forth in claim 1 further comprising:

a first sliding wall forming a part of said passageway adjuster, said first sliding wall slidably and adjustably disposed in a first slot;

a second sliding wall forming a part of said passageway adjuster, said second sliding wall slidably and adjustably disposed in a second slot;

a first transverse ratchet defining a portion of said first and second slots;

a second transverse ratchet disposed on said first sliding wall and said second sliding wall; and wherein said first transverse ratchet and said second transverse ratchet interlock to permit slidable adjustment of said first and second sliding walls to vary said variable length passage.

3. The lock actuated by the insertion object as set forth in claim 1 further comprising:

a first vertical ratchet disposed on said first retainer;

a second vertical ratchet interlocking with said first vertical ratchet; and wherein said interlocking of said first vertical ratchet and said second vertical ratchet permits adjustment of said first retainer to said plurality of vertical positions.

4. The lock actuated by the insertion object as set forth in claim 1 further comprising:

a rocker forming part of said means for blocking said adjustment from said retracted position to said extended position, said rocker being adjustable to said blocking position and said unblocking position;

an angular bend having a vertex, said angular bend forming a part of said rocker;

a second protrusion forming a part of said rocker;

an insertion object retention area formed by said first retainer;

an aperture defined by said bolt, said aperture having a lower portion defined by a step, and wherein said rocker in said blocking position has said angular bend disposed in said insertion object retention area, said angular bend is in the way of said pathway of said insertion object, and in said blocking position said second protrusion is in a pathway of said step, and wherein said rocker in said unblocking position has said second protrusion out of said pathway of said step, and in said unblocking position, said angular bend is disposed out of the way of said pathway for said insertion object by said insertion object disposed in the insertion object retention area.

5. The lock actuated by the insertion object as set forth in claim 1 further comprising:

a second retainer having a second retainer first member and a second retainer second member, said second retainer first member is connected to said bolt;

an interference position and a clearance position defined by said second retainer, and wherein placement of said bolt in said extended position positions said second retainer in said interference position, said second retainer positioned in said interference position has said second member in the way of said pathway for said insertion object, and wherein said bolt positioned in said retracted position positions said second retainer in said clearance position, said second retainer in said clearance position has said second member out of the way of said pathway for said insertion object.

6. The lock actuated by the insertion object as set forth in claim 1 further comprising:

a rotatable shutter disposed in a plane between the insertion slot and the passageway adjuster;

an oblique aperture defined by said shutter;

a vertically elongated member having a first end and a second end, said vertically elongated member first end disposed in the oblique aperture and said vertically elongated member second end removably coupled to said bolt, and wherein movement of said bolt to said extended position rotates said shutter to place said shutter in a first shutter position, said shutter in said first shutter position is disposed between the insertion slot and the passageway adjuster, said shutter in said first shutter position blocks said pathway of said insertion object.

7. The lock actuated by the insertion object as set forth in claim 1 further comprising:

a removable cover having a return receptacle said removable cover connected to said housing.

8. The lock actuated by the insertion object as set forth in claim 1 further comprising:

a collection box connected to a bottom portion of said housing;

a removable tray connected to said housing, said tray constitutes a floor of a return box to return said insertion object to the user.

9. The lock actuated by the insertion object as set forth in claim 1 further comprising:

an object securing member connected to the housing, said object securing member having a chain and a peg;

means to lock said peg to said bolt.

10. The lock actuated by an insertion object as set forth in claim 1 further comprising:

a tube providing a pathway to direct an insertion object into said insertion slot.

11. The lock actuated by the insertion object as set forth in claim 1 further comprising:

a removable corner bracket disposed on an interior of said receptacle;

an inclined plane defined by said corner bracket;

a removable stop disposed in said receptacle, and wherein said inclined plane defines a portion of said passageway for said insertion object, and wherein said removable stop aids in directing said insertion object, to a coin box or a return box.

12. The lock actuated by an insertion object as set forth in claim 1 wherein said means for blocking further comprises:

a rocker being adjustable to said blocking position and said unblocking position;

an electromagnet disposed in said receptacle, said electromagnet causes said rocker to move to said unblocking position.

13. The lock actuated by an insertion object as set forth in claim 2 further comprising:

a scale disposed on a portion of said lock actuated by an insertion object, said scale disposed in a position to permit measurement of an adjustment of said variable length passage.

14. The lock actuated by the insertion object as set forth in claim 3 further comprising:

a scale disposed on a portion of said lock actuated by an insertion object, said scale to permit measurement of a vertical adjustment of said first retainer to said plurality of vertical positions.

15. The lock actuated by the insertion object as set forth in claim 3 further comprising:

an oscillating support bounding and supporting a side of said first retainer;

a vertical section forming a part of said oscillating support, said second vertical ratchet disposed on said vertical section;

a horizontal section forming a part of said oscillating support, said horizontal section having a heel, said horizontal section having a recessed portion adjacent to said heel;

a protrusion disposed on said bolt; and wherein said bolt in said retracted position supports said heel with said protrusion, and wherein said bolt in said extended position has said protrusion disposed in said recessed portion.

16. The lock actuated by the insertion object as set forth in claim 4 further comprising:

a spring connected to said rocker to help retain said rocker in said blocking position.

* * * * *